US005159242A

United States Patent [19]

Ravi

[11] Patent Number: 5,159,242

[45] Date of Patent: Oct. 27, 1992

[54] HIGH PRESSURE DISCHARGE LAMP HAVING AN INTEGRAL THICK FILM RESISTOR WITH MULTIPLE RESISTIVE ELEMENTS

[75] Inventor: Jagannathan Ravi, Elmira, N.Y.

[73] Assignee: North American Philips Corporation, New York, N.Y.

[21] Appl. No.: 626,914

[22] Filed: Dec. 12, 1990

[51] Int. Cl.[5] ..... H01J 7/44; H01K 1/62

[52] U.S. Cl. ..... 315/52; 315/58; 315/60; 315/71; 315/73; 313/25; 338/293; 338/308

[58] Field of Search ..... 315/58, 59, 60, 46, 315/47, 71, 73, 74, 75, 52; 313/25, 634, 570, 573; 338/308, 293

[56] References Cited

U.S. PATENT DOCUMENTS 3,353,136 11/1967 Umantsev ..... 338/308
3,947,799 3/1976 Epaneshnikova et al. ..... 338/9
4,258,288 3/1981 Michael et al. ..... 315/60
4,792,782 12/1988 Hammond ..... 338/308
4,901,051 2/1990 Murata et al. ..... 338/308
5,015,916 5/1991 Mazza et al. ..... 315/73

FOREIGN PATENT DOCUMENTS 5673856 11/1979 Japan .
1-211896 8/1989 Japan .

*Primary Examiner*—Eugene R. LaRoche
*Assistant Examiner*—Michael B. Shingleton
*Attorney, Agent, or Firm*—Brian J. Wieghaus

[57] ABSTRACT

A high pressure discharge lamp having a thick film resistor comprising a plurality of resistive elements. A first resistive element is included in a starting circuit for the lamp and a second resistive element is in series with the arc tube during lamp operation for flicker elimination. The integral thick film resistor facilitates mounting and connection of the resistor elements within the lamp envelope.

16 Claims, 2 Drawing Sheets

HIGH PRESSURE DISCHARGE LAMP HAVING AN INTEGRAL THICK FILM RESISTOR WITH MULTIPLE RESISTIVE ELEMENTS

CROSS-REFERENCE TO RELATED APPLICATIONS

The copending application Serial No. 626,913 filed concurrently with this application entitled "High Pressure Discharge Lamp Having A Simplified Mount Construction" of Kenneth E. Pearson and Ronald T. Robertson discloses and claims an HPS discharge lamp having an insulative support between the discharge vessel and lamp stem and a series resistance comprised of a thick-film resistor mounted proximate the lamp stem.

BACKGROUND OF THE INVENTION

1. Field of the Invention

The invention relates to high pressure discharge lamps, and more specifically, to high pressure discharge lamps having a plurality of resistors included within the outer lamp envelope.

2. Description of the Prior Art

High pressure discharge lamps, including high pressure sodium vapor discharge (HPS) lamps, metal halide lamps, and mercury vapor lamps, often have multiple power-dissipating resistors included in the lamp circuit and within the outer lamp envelope. Power resistors are typically considered to be resistors which dissipate greater than about 1 watt during operation. One or more resistors often form part of a starting circuit within the envelope for starting the discharge vessel, or arc tube. In metal halide lamps and mercury vapor lamps, the starting circuit typically has an auxiliary electrode adjacent a main electrode, which auxiliary electrode is connected with the opposite main electrode through a current limiting resistor. Often a bimetal switch is in series with the current limiting resistor to remove the resistor and the auxiliary electrode after starting and stabilization of the discharge arc. A common starting circuit for HPS lamps includes a glow starter switch in series with a current limiting resistor and a bimetal, all of which are in parallel circuit with the arc tube. Resistors used in this type of HPS starting circuit typically have a resistance of over a hundred ohms and dissipate high power, on the order of several hundred watts. They are electrically disconnected from the arc tube circuit by the glow switch shortly after ignition of the discharge arc, typically within approximately 20 seconds after initial application of an electric current to the lamp. Several minutes after ignition of the discharge arc, the bimetal opens in response to heat from the discharge vessel to physically and electrically disconnect the glow switch and starting resistor from the arc tube circuit.

Additional resistors may be in the arc tube circuit during lamp operation to improve lamp performance. For example, U.S. Pat. No. 4,258,288 (Michael et al) discloses a metal halide high-intensity discharge (HID) lamp for connection to a constant wattage (CWA) ballast of the type having a transformer with a secondary winding in series with a capacitor. The lamp has an internal voltage-doubler starting circuit with two resistors in series with a bimetal switch. The bimetal switch disconnects the starting circuit and auxiliary electrode after starting of the lamp. The lamp also has a third power resistor in series with the arc tube which reduces the phase shift between the lamp voltage and the ballast open circuit voltage during lamp warm-up. The resistor increases the maximum sustaining voltage to the lamp when the lamp current is zero, thereby preventing flicker and extinguishment of the arc.

Japanese Kokai 1-211896 shows an unsaturated high pressure sodium discharge lamp suitable for operation on a CWA ballast. The lamp has a resistor in series with the arc tube to reduce the reignition voltage of the arc tube to prevent flicker of the arc, which otherwise occurs under certain operating conditions of the ballast and lamp. Because the resistor is in series with the arc tube, it operates continuously during lamp operation after ignition of the discharge arc and dissipates considerable power, approximately 15 watts for a 150 watt lamp.

Various types of power resistors have been used in high pressure discharge lamps, including filament resistors and miniature incandescent lamps. Filament resistors used in starting circuits have the disadvantage that they generally must be long, and as a result are formed into coils and/or suspended in zig-zag form, causing space and mounting problems within the lamp envelope. They are also sensitive to vibrations and mechanical shock, and consequently are a source of lamp failures. The use of miniature incandescent resistor lamps has typically been confined to continuous duty applications, such as the series flicker elimination resistor in unsaturated HPS lamps. Although the life of miniature lamps for this application must be longer than the life of the arc tube, typically greater than 15000 hours, their filament is also subject to failure from shock and vibration and may be the cause of lamp failure.

Recently, ceramic thick film resistors, wherein a thick film resistive element such as tungsten is disposed on a ceramic substrate, have been used in starting circuits for HID lamps. For example, U.S. patent application Ser. No. 07/378,879 filed Jul. 12, 1989 shows a thick film resistor in a starting circuit for high pressure sodium discharge lamps. J. P. Kokai 56-73856 discloses a thick film resistor as a starting resistor for metal halide lamps and high pressure sodium discharge lamps. Thick film resistors are suitable for starting circuits because they reliably dissipate the required several hundred watts for the period just prior to lamp starting ($\approx$20 sec) while having a long life.

However, the use of thick film resistors in HID lamps for continuous duty operation has not been evident. For example, J. P. Kokai 1-211896 shows a tungsten filament resistor for flicker elimination. The resistor is mounted to the lamp frame at the dome end of the outer envelope, which requires a complicated construction and causes shadowing of the light emitted from the lamp. Even where a thick film resistor has been employed in a starting circuit for very high power dissipation prior to starting, separate resistors have been used for lower power applications. For example, J. P. 56-73856 shows a conventional carbon resistor in series with the auxiliary electrode in addition to the thick film short-duty starting resistor.

Accordingly, prior HID lamps having multiple resistor means have employed separate resistor components for each resistor means and suffer from the complexity, cost, and reliability problems associated with handling, mounting, and connecting multiple resistor components to other elements within the lamp envelope. Additionally, although not discussed in J. P. Kokai 1-211896, CWA mercury ballasts do not have a starter. In unsaturated high pressure sodium discharge lamps for operation on this type of ballast, it is desirable to include a starting circuit within the lamp envelope. However, mounting of the starting resistor, glow starter, and bimetal switch near the base end of the lamp envelope is space consuming and typically requires multiple welds to the lamp frame. Mounting of an additional flicker elimination resistor component on the lamp frame between the discharge vessel and the lamp stem has not been practicable. For mercury-retrofit HPS lamps, the light center length of the arc tube measured from the base should equal the light center length of the mercury vapor lamp which it replaces to obtain optimum optical performance in the luminaire. Thus, it is not feasible to position the arc tube further from the base to obtain more mounting space on the frame in such a lamp.

SUMMARY OF THE INVENTION

It is an object of the invention, in high pressure discharge lamps having multiple resistor means disposed within the lamp envelope, to eliminate the problems of handling, mounting, and connecting separate resistor components in the lamp envelope.

It is another object of the invention to reduce the cost and increase the reliability of HID lamps having multiple resistor means.

Yet another object of the invention is to simplify the construction of HID lamps having a starting circuit with a first resistor which dissipates very high power prior to lamp starting and a second resistor in series with an arc tube which continuously dissipates considerable power during lamp operation.

According to the invention, in a high pressure discharge lamp having a discharge vessel, or arc tube, and multiple resistor means arranged within an outer envelope, a thick film resistor having an integral substrate is provided which comprises a plurality of the resistor means. The lamp according to the invention has the advantage that the number of resistor components which must be mounted in the lamp is less than the number of resistor means required in the lamp. Preferably, the thick film resistor comprises all of the resistor means so that only one resistor component, the integral thick film resistor, needs to be mounted within the lamp envelope. In addition to simplifying the mount structure and increasing the ruggedness of the lamp, the use of one resistor component reduces the number of parts which must be handled during lamp assembly, reducing loss and breakage, and consequently lamp cost.

The resistor means included in the integral thick film resistor are comprised of corresponding metallic resistive elements, such as conventional metallic deposition patterns, all of which may be disposed on a single substrate. However, in a particularly advantageous embodiment, the thick film resistor comprises a plurality of integral substrate layers with the metallic resistive elements disposed between corresponding layers. This has the advantage that the length and width dimensions of the substrate may be minimized to the dimensions required by the metallic deposition pattern of the resistive element with the highest ohmic value. For example, the pattern for a resistive element may be disposed on a first substrate layer and the patterns for one or more elements of substantially less resistance may be arranged on a second substrate layer, or on the reverse side of the same substrate within the dimensions of the larger resistive pattern. Alternatively, each pattern may be disposed on a respective substrate layer.

The conventional materials used for thick film resistive elements, for example, tungsten, typically has a resistance which is temperature dependent and increases with increasing temperature. If included in an HID lamp on a separate substrate, a continuous duty resistive element having a resistance suitable for flicker elimination would take time to reach its designed operating resistance. This is a disadvantage because the optimum resistance required for flicker elimination would not be achieved until several minutes after initial flow of the arc tube current through the resistor.

The above problems are alleviated in another embodiment in which a high pressure discharge lamp has an integral thick film resistor comprising a first resistive element which dissipates power prior to ignition of the discharge arc and a second resistive element operative after ignition of the discharge arc. The first and second resistive elements are arranged on the substrate such that heat from the first resistive element during starting of the lamp raises the temperature of the second resistive element such that it reaches its designed steady-state resistance faster than if heated from the arc tube current alone. The heating of the second resistive element prior to arc ignition has the additional advantage of less thermal shock to that element upon flow of the arc current, and reduced chances of failure of the second resistive element, and the lamp, caused by the effects of thermal shock.

A desirable thick film resistor for obtaining optimum heating of the second resistive element while providing a practical construction consists of three integral insulative substrates, the first resistive element being disposed between a first and second of said substrates and the second resistive element being disposed between the second and a third of said substrates.

Thick-film resistors can be damaged if subject to excessive temperatures, for example, 700° to 800° C. if silver-copper brazing is used for attachment of the resistor terminals. This temperature could be reached in a standard starting circuit for an HPS lamp if the discharge vessel did not ignite within a predetermined time period, which would result in the first resistive element (starting resistor) not being disconnected by the series bimetal in response to heat from the discharge vessel. Protection from damaging temperatures may be possible with a substrate of sufficiently large area, however, this would result in an unwieldy resistor. Thus, according to another embodiment, means are provided for disconnecting the resistive element in response to heat from the thick film resistor to prevent damage from excess temperature. The means may be a second bimetal switch. However, a single bimetal is preferably arranged on the resistor, in series with the first resistive element, to disconnect the first resistive element in response to heat from the discharge vessel upon successful ignition of a discharge arc or, in the event of unsuccessful ignition of the discharge vessel, in response to heat from the resistor before the resistor reaches a damaging temperature.

According to the preferred embodiment of the invention, the HID lamp is an unsaturated high pressure sodium discharge lamp having said integral thick film ceramic resistor with said first and second resistive elements. The first resistive element forms part of a starting circuit for the discharge vessel. The first resistive element is in series with a glow discharge starter and a normally closed bimetal element which opens in response to heat from the discharge vessel and/or the thick film resistor for removing the resistor and the glow starter from the lamp circuit either upon successful ignition of the discharge vessel or upon the resistor reaching its maximum safe temperature. The second resistive element is in series with the discharge vessel during lamp operation for eliminating flicker of the discharge arc when the lamp is operated on a constant wattage type ballast.

DESCRIPTION OF THE PREFERRED EMBODIMENT

Figure 1A:
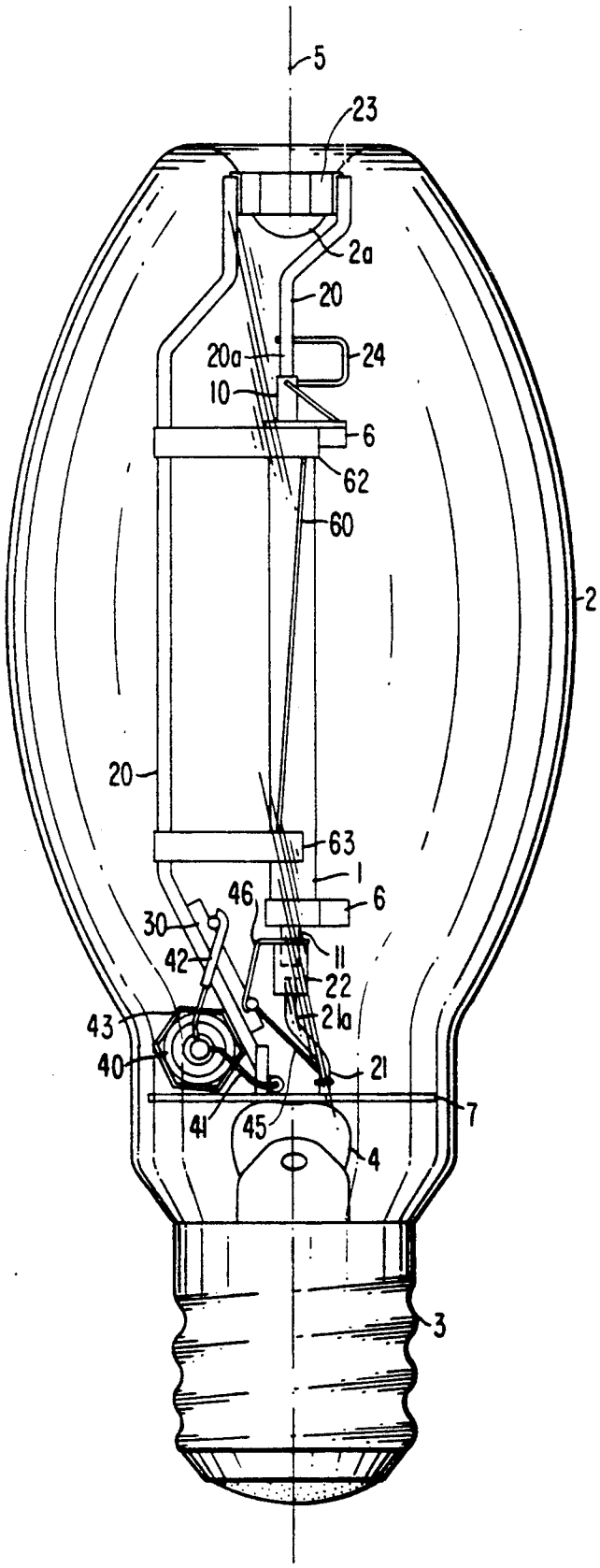
FIG. 1A and 1B illustrate a high pressure sodium vapor discharge lamp according to the invention having an integral thick film resistor with a plurality of integral substrates and resistive elements.

The lamp shown in FIG. 1 is a 150 watt high pressure sodium (HPS) discharge lamp comprised of an elongate discharge vessel, or arc tube, 1 of the unsaturated type disposed within an outer envelope 2 and having a lamp base 3 at one end of the outer envelope 2. The envelope is evacuated, and sealed in a conventional manner by stem 4. A conventional heat deflector 7 protects the glow switch from excessive heating during sealing of the stem to the outer envelope. The discharge vessel has a pair of conductive feed-throughs 10, 11 for applying a voltage to a pair of discharge electrodes Within the discharge vessel. Conventional metallic heat shields 6 surround the discharge electrodes adjacent the ends of the arc tube 1.

A quantity of sodium-mercury amalgam is contained within the discharge vessel 1, together with an inert buffer gas such as xenon. The discharge vessel is supported within the lamp envelope by conductive support rods 20 and 21 and insulative glass support element 22. The glass support 22 has opposing bores for receiving the end 21*a* of support rod 21 and feed-through 11, to support the arc tube and electrically insulate the feed-through 11 from conductive support 21.

Figure 1B:
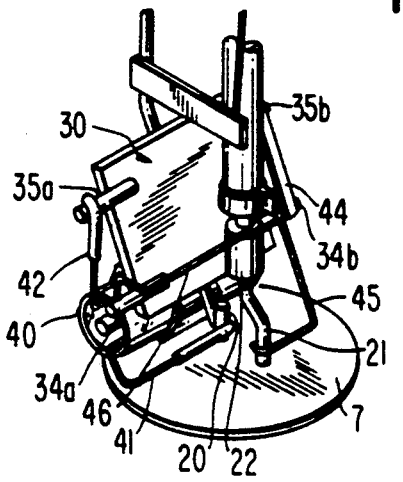
Figure 2:
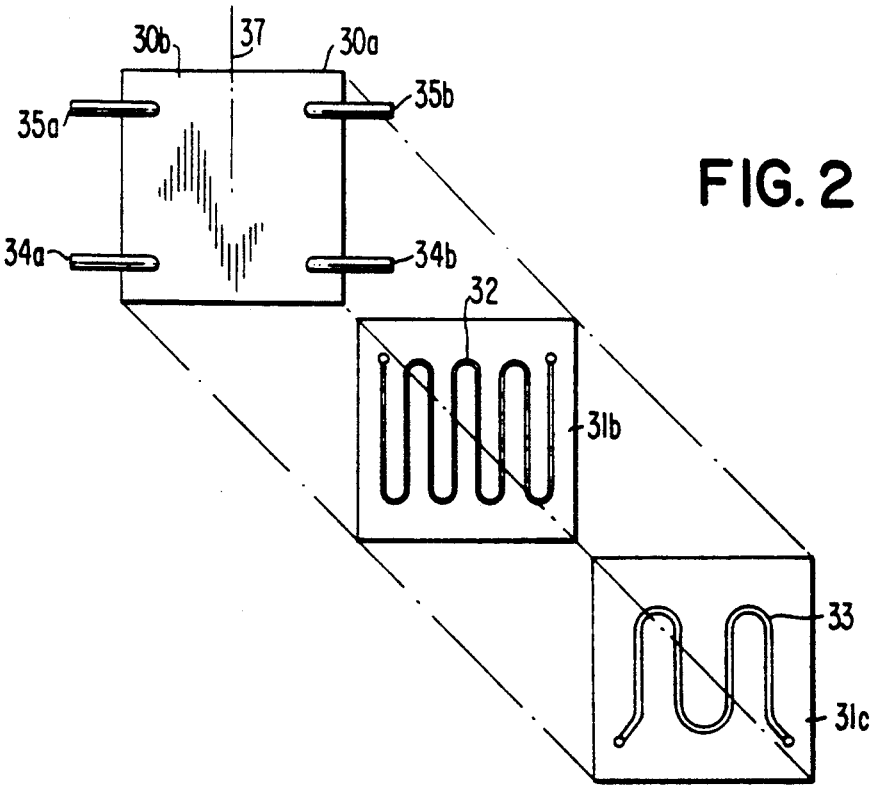
FIG. 2 shows an exploded view of the thick film resistor.

An integral ceramic thick-film resistor 30 is secured between the conductive support rods adjacent the stem and has a first resistive element included in a starting circuit for the discharge vessel and a second resistive element connected in series with the discharge vessel 1. The thick film resistor has 3 ceramic substrate layers 31*a*, 31*b*, and 31*c* of Alumina 90%. As shown schematically in FIG. 2, a first resistive element 32 consisting of a conventional deposited tungsten thick film pattern is disposed on the substrate layer 31*b* and a second resistive element 33 also of a conventional tungsten thick film is disposed on substrate layer 31*c*. The first substrate layer 31*a* protects the first resistive element. Resistor terminals 34*a*, 34*b* on substrate 31*a* are connected to the second resistive element 33 and terminals 35*a*, 35*b* are connected to the first resistive element 32. Alternatively, the first and second resistive elements may be deposited on opposite sides of substrate 31*b*, the resistive elements being protected by outer layers 31*a*, 31*c* or by a protective coating applied over the resistive elements. The metallic deposition patterns themselves are conventional and the number of patterns for any given resistance value which may be needed in an HID lamp are numerous. The resistor 30 is secured between the conductive rods by support-lead 45 welded to terminal 34*b* of the resistor and conductor 21 (FIG. 1B).

A starting circuit for starting the discharge vessel consists of a conventional glow starter switch 40, having a pair of bimetallic electrodes therein, in series with the first resistive element 32 and a bimetal switch 44 welded to terminal 34*b* and normally closed against terminal 35*b*. The glow starter 40 is supported by a glow starter holder 43 welded to the conductive support 20. The starting circuit defines a first conductive path in parallel with the discharge vessel 1. The starting circuit consists of a first lead 41 of the glow starter connected to the conductive support rod 20, the glow starter, a second glow starter lead 42 connected to resistor terminal 35*a*, the first resistive element 32, the resistor terminal 35*b*, bimetal switch 44, terminal 34*b*, and support-lead 45 connected to conductive support 21.

A second conductive path extends from the conductive support rod 21, through support-lead 45 to terminal 34*b* of the second resistive element, through the second resistive element 33, the other terminal 34*a*, lead 46, and through niobium feed through 11 through the discharge vessel 1, through niobium feed through 10, connector 20*b* and conductive rod The lamp also has a starting aid for inducing ionization throughout the discharge vessel within the limits of the high voltage pulse of the starting circuit. The starting aid consists of conventional antenna 60 and bimetal elements 62 and 63 which are welded to the support rod 20. In the inoperative condition of the lamp, the bimetal elements 62, 63 hold the starting antenna against the wall of the discharge vessel.

The functioning of the starting aid and the starting circuit during ignition of the lamp are as follows. When connected to an inductive stabilization ballast of the constant wattage or reactor type, and the AC supply current is effected, a glow discharge will first be produced in the glow starter 40, which heats the bimetallic electrodes within such that the glow starter electrodes touch and extinguish the glow discharge. A current of high intensity will then flow through the ballast. During this time, the first resistive element 32 limits the current through the glow starter and heats the substrate and the second resistive element 33. Upon cooling, the glow starter electrodes will separate, interrupting the current through the ballast, and causing a high voltage peak across the discharge electrodes of the discharge vessel 1. Simultaneously, a high voltage potential will also be applied between the starting antenna 60, via the bimetal elements 62, 63 and conductor 20, and the discharge electrode adjacent the feed-through 11. This causes substantial ionization of the buffer gas throughout the discharge vessel, and starting of the discharge due to the large potential difference between the discharge electrodes. At this time, lamp current flows through the second conductive path described above, including the second resistive element which has been heated by the first resistive element prior to ignition of the discharge arc.

After ignition of the discharge arc, the voltage between the discharge electrodes will be below the voltage value of the glow starter electrodes, the glow starter will remain extinguished, and current will not flow through the glow starter or starting resistor. After several minutes, heat from the discharge vessel 1 causes the bimetal switch 44 to open and electrically disconnect the glow starter 40 and the first resistive element 32 from conductor 21 so that the glow starter and first resistive element are no longer connected electrically in parallel with the discharge vessel. Heat from the discharge vessel also causes the bimetals 62 and 63 to move the starting antenna 61 away from the discharge vessel.

In the event of unsuccessful ignition of the discharge vessel, heat from the resistor substrate causes the bimetal switch 44 to open before the resistor exceeds a temperature of approximately 600° C., typically within a minute of energization of the lamp.

In the lamp shown in FIG. 1, the value of the first resistive element is 165 ohms at 23° C. and dissipates approximately 200 watts during operation of the starting circuit. If the discharge arc is successfully ignited, the first resistive element is operative for only approximately 15 to 20 seconds after initial application of the electric potential to the lamp. The value of the second resistive element after the resistor substrate has reached a steady operating temperature of approximately 425° C. is 6–8 ohms. The second resistive element dissipates approximately 15 Watts and is effective for reducing the reignition arc voltage of the arc tube to prevent flicker, under certain conditions, of the discharge arc when the lamp is operated on a CWA ballast.

The integral combination resistor has width and height dimensions which are no larger than the dimensions of a similar thick film resistor having only a 165Ω resistive element for a starting circuit. The incorporation of a series flicker elimination resistor into the same sized component effectively eliminates the mounting of an additional resistor component for the series flicker elimination element and facilitates a simpler mount construction.

Another advantage of a combination resistor is that cost savings can be obtained for a resistor which includes series flicker elimination resistors for different lamp wattages. As previously mentioned, a series resistor for flicker elimination typically has a resistance which is a fixed percentage of the lamp wattage. Thus, series resistors for different wattage lamps could be included in one thick film resistor component and the same resistor component used for different wattage lamps, with only the terminals for the respective series resistor being connected in each size lamp. Cost savings can be achieved through large scale production of only one resistor for different lamps.

In addition to the mounting and reliability advantage of providing the integral ceramic resistor in the lamp shown in FIG. 1, the provision of the high power dissipating starting resistive element 32 on an integral substrate with the lower power dissipating flicker elimination resistive element 33 has the advantage that during starting the heat from the first resistive element heats the substrate so that the resistance of the lower resistive element 33 increases more quickly to its desired operating value. This has the operational advantage that the reignition arc voltage of the arc tube was reduced, and flicker prevented more quickly than with a separate resistor component. In the inoperative condition of the lamp, the second resistive element 33 has a value of approximately 2.1 ohms in the inoperative state of the lamp and an operating value of 6 ohms with a substrate temperature of approximately 425° C.

The combination of the lower wattage flicker elimination resistor with the high wattage starting resistor on an integral substrate also has the advantage that the lower wattage resistor 33 is substantially pre-heated by the first resistive element prior to flow of the lamp current, and is thus subject to reduced thermal shock.

While there has been shown to be what are presently considered to be the preferred embodiments of the invention, it will be apparent to those of ordinary skill in the art that modifications can be made to the lamps without departing from the scope of the invention as defined by the appended claims.

I claim:

1. In a high pressure discharge lamp having a lamp envelope, a discharge vessel disposed within said envelope and energizable for emitting light, and multiple resistor means within said envelope, the improvement comprising:

an integral thick film resistor comprising a plurality of said resistor means.

2. In a high pressure discharge lamp according to claim 1, wherein said integral thick film resistor comprises a plurality of integral substrate layers and said plurality of resistor means are comprised of metallic resistive elements disposed on corresponding substrate layers.

3. In a high pressure discharge lamp according to claim 2, wherein said integral thick film resistor comprises three substrate layers, a first resistive element being disposed between a first and second of said layers and a second resistive element being disposed between a second and third of said layers.

4. In a high pressure discharge lamp according to claim 3, wherein said lamp further comprises a starting circuit for igniting said discharge vessel which includes said first resistive element, and said second resistive element being electrically in series with said discharge vessel during lamp operation.

5. In a high pressure discharge lamp according to claim 4, further comprising disconnecting means for electrically disconnecting said first resistive element for preventing said integral thick film resistor from exceeding a predetermined temperature.

6. In a high pressure discharge lamp according to claim 5, wherein said disconnecting means comprises a bimetal switch mounted on said integral thick film resistor and effective for disconnecting said first resistive element in response to heat from said integral thick film resistor in the event of unsuccessful ignition of said discharge vessel and in response to heat from said discharge vessel in the event of successful ignition of said discharge vessel.

7. In a high pressure discharge lamp according to claim 6, wherein said second resistive element is effective for preventing flicker of light emitted from said discharge vessel when said lamp is operated on a constant wattage type ballast.

8. In a high pressure discharge lamp according to claim 4, wherein said second resistive element is effective for preventing flicker of light emitted from said discharge vessel when said lamp is operated on a constant wattage type ballast.

9. In a high pressure sodium discharge lamp having an outer envelope, a discharge vessel disposed within said outer envelope energizable for maintaining a discharge during lamp operation and having a fill comprising sodium and mercury, starting means connected to said discharge vessel for generating a voltage sufficient for inducing ionization through said discharge vessel and comprising a first power resistor, and a second power resistor electrically in series with said arc tube during lamp operation, said first and second resistors being disposed within said outer envelope, the improvement comprising:

an integral thick film resistor comprises said first and second power resistor.

10. In a high pressure sodium discharge lamp according to claim 9, wherein said integral thick film resistor comprises three integral substrate layers, said first and second power resistors being disposed between alternate substrate layers, and said first power resistor of said starter means dissipates power and heat during lamp start-up and heats said second power resistor to increase its resistance above its ambient resistance.

11. In a high pressure discharge lamp according to claim 10, further comprising disconnecting means for electrically disconnecting said first resistive element for preventing said integral thick film resistor from exceeding a predetermined temperature.

12. In a high pressure discharge lamp according to claim 11, wherein said disconnecting means comprises a bimetal switch mounted on said thick film resistor and effective for disconnecting said first power resistor in response to heat from said thick film resistor in the event of unsuccessful ignition of said discharge vessel and in response to heat from said discharge vessel in the event of successful ignition of said discharge vessel.

13. In a high pressure discharge lamp according to claim 12, wherein said second power resistor is effective for preventing flicker of light emitted from said discharge vessel when said lamp is operated on a constant wattage type ballast.

14. An integral thick film resistor for a lamp circuit of a high pressure discharge lamp, said resistor comprising:

first and second thick film power resistive elements, each for dissipating an electrical power of greater than about one watt during lamp operation; and an electrically insulative substrate arranged between said resistive elements, said second resistive element having an electrical resistance at the operating temperature of the discharge lamp which is substantially greater than its electrical resistance at a lower ambient temperature, and when said thick film resistor is included in a lamp circuit in which said first power resistor dissipates power for a first time period and said second power resistor dissipates power for a second time period beginning a predetermined time lag after the beginning of said first time period, said first resistive element is effective for preheating said second resistive element to substantially increase its resistance during said predetermined lag.

15. An integral thick film resistor according to claim 14, wherein said resistor consists of three substrate layers and said two power resistive elements each disposed on a respective said layer, said first resistive element is a high wattage short duty resistor suitable for dissipating high power in a lamp starting circuit of a high pressure discharge lamp and said second resistive element is a low wattage resistor for continuously dissipating low wattage during operation of the high pressure discharge lamp.

16. An integral thick film resistor according to claim 15, wherein said second resistive element is effective for reducing flicker in a high pressure discharge lamp operated on a constant wattage type ballast when connected electrically in series with the arc tube of the high pressure discharge lamp.

* * * * *